US007726510B2

(12) United States Patent
Bootz

(10) Patent No.: US 7,726,510 B2
(45) Date of Patent: Jun. 1, 2010

(54) BRUSH WIPING DEVICE AND METHOD OF USE

(76) Inventor: David T. Bootz, 5795 W. Edgewood Dr., Appleton, WI (US) 54913

( * ) Notice: Subject to any disclaimer, the term of this patent is extended or adjusted under 35 U.S.C. 154(b) by 497 days.

(21) Appl. No.: 11/804,569

(22) Filed: May 18, 2007

(65) Prior Publication Data

US 2007/0221675 A1 Sep. 27, 2007

Related U.S. Application Data

(63) Continuation-in-part of application No. 10/347,546, filed on Jan. 21, 2003, now abandoned.

(51) Int. Cl.
*B65D 25/34* (2006.01)

(52) U.S. Cl. ..... 220/697; 220/699

(58) Field of Classification Search ..... 220/695, 220/697, 699, 698, 700, 702
See application file for complete search history.

(56) References Cited

U.S. PATENT DOCUMENTS 557,118 A 3/1896 Ellis
2,639,835 A 5/1953 Nelson
2,960,257 A 11/1960 Sasse
3,894,650 A 7/1975 Crump
3,945,527 A 3/1976 Pylant
4,225,064 A * 9/1980 Westcott ..... 222/569
4,893,723 A 1/1990 Seabolt
5,626,258 A 5/1997 Maiorino
5,662,242 A 9/1997 Steo

* cited by examiner

*Primary Examiner*—Stephen Castellano
(74) *Attorney, Agent, or Firm*—Brannen Law Office, LLC

(57) ABSTRACT

A brush wiping device and a method of using the brush wiping device is disclosed. The brush wiping device can be attached to an upper surface of a container which is capable of housing a fluid, for example, paint. The brush wiping device includes a first surface, a second surface and a thickness therebetween. The brush wiping device also includes an outer perimeter and an inner perimeter. The inner perimeter extends completely through the thickness of the brush wiping device and is configured to include a brush dipping aperture, a brush wiping aperture and a brush transfer aperture. The brush transfer aperture communicates with both the brush dipping aperture and the brush wiping aperture. The brush wiping device further includes an attachment member used to removably secure the brush wiping device to the upper surface of the container.

7 Claims, 2 Drawing Sheets

BRUSH WIPING DEVICE AND METHOD OF USE

This application is a CIP of Ser. No. 10/347,546 filed Jan. 21, 2003, now abandoned.

FIELD OF THE INVENTION

This invention relates to a brush wiping device and a method of use. More specifically, this invention relates to a paint brush wiping device and a two stroke method of removing excess paint from the bristles of the paint brush.

BACKGROUND OF THE INVENTION

Today, there are many different devices which can be removably attached to an upper surface of a container, for example a one-gallon can of paint, and be used to remove excess paint from a paint brush. In addition, some of these devices also assist in pouring the paint out of the can, providing a rest for a paint brush, etc. U.S. Pat. No. 2,639,835 issued to D. H. Nelson is one such device which provides a paint brush rest. This device is a semi-circular device having a plurality of spaced apart rods that provides a rest for a paint brush when the painter needs to set his brush aside for awhile. U.S. Pat. No. 2,960,257 issued to L. Sasse teaches a device which utilizes a scrapper bar positioned across the opening of a circular brim which can be used to scrape excess paint from a paint brush. U.S. Pat. No. 4,893,723 issued to J. K. Seabolt teaches a combination pour spout and paint paddle scraper. U.S. Pat. No. 5,626,258 issued to A. E. Maiorino teaches still another device in the form of a paint lid which can be attached to a paint can for use with a paint brush. This device includes a fluid guide means and an inclined guide plate for facilitating pouring paint from the paint can. However, each of these devices suffers from one or more deficiencies.

A person who desires to paint a room or an object typically will dip a paint brush into a paint can and then wipe the excess paint from the bristles of the paint brush using the rim of the paint can. A person will normally wipe the two major sides and the two rounded ends of a paint brush against the rim of the paint can before painting. Commonly, all four surfaces of a paint brush are wiped in this fashion. This action allows for a more even amount of paint to be applied to the intended surface by the painter. However, the two major sides of a paint brush are relatively flat while the inside surface of a paint can is curved or arcuate in profile. This geometrical difference prohibits all of the excess paint from being removed from the bristles of the paint brush.

Furthermore, it takes time to wipe the two major sides and the two rounded ends of a paint brush against the inside rim of a paint can. In addition, such wiping motion can become tedious and tiring to the painter.

Now a brush wiping device and method have been invented that allows excess or surplus paint or other fluid, such as varnish, stain, shellac, a liquid wall paper remover, etc. to be quickly and efficiently removed from a brush in two easy strokes, thus saving time and allowing the painter to more efficiently perform his task. In addition, the brush wiping device is an integral member which can be easily cleaned and reused on another paint can.

SUMMARY OF THE INVENTION

Briefly, this invention relates to a brush wiping device and a method of using the brush wiping device. The brush wiping device can be attached to an upper surface of a container which is capable of housing a fluid, for example, paint. The brush wiping device includes a first surface, a second surface and a thickness therebetween. The brush wiping device also includes an outer perimeter and an inner perimeter. The inner perimeter extends completely through the thickness of the brush wiping device and is configured to include a brush dipping aperture, a brush wiping aperture and a brush transfer aperture. The brush transfer aperture communicates with both the brush dipping aperture and the brush wiping aperture. The brush wiping device further includes an attachment member used to removably secure the brush wiping device to the upper surface of the container.

The general object of this invention is to provide a brush wiping device that can be removably attached to an upper surface of a container which houses a liquid, such as paint, and which facilitates removal of excess liquid from the bristles of a brush. A more specific object of this invention is to provide a brush wiping device that can be removably attached to an upper surface of a paint container and be used to remove excess or surplus paint collected on the bristles of a paint brush.

Another object of this invention is to provide a reusable brush wiping device which has no moving parts.

A further object of this invention is to provide a brush wiping device which is easy to manufacture and economical to produce.

Still further, an object of this invention is to provide a brush wiping device that can be easily attached to a one-gallon paint can.

Other objects and advantageous of the present invention will become apparent to those skilled in the art in view of the following description and the accompanying drawings.

DETAILED DESCRIPTION OF THE INVENTION

Figure 1:
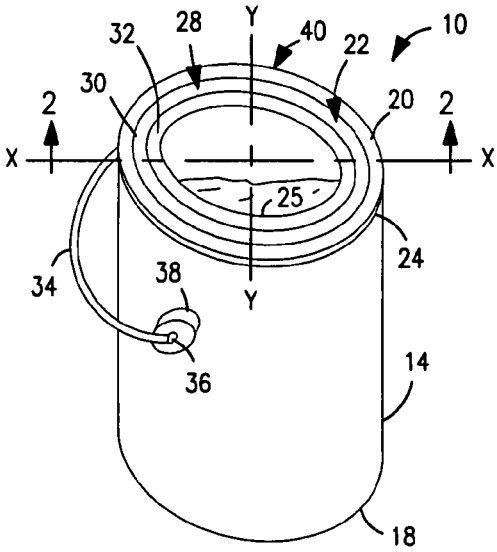
FIG. 1 is a perspective view of a cylindrically shaped, one-gallon paint can with the lid removed and with paint being present inside the paint can.
Figure 2:
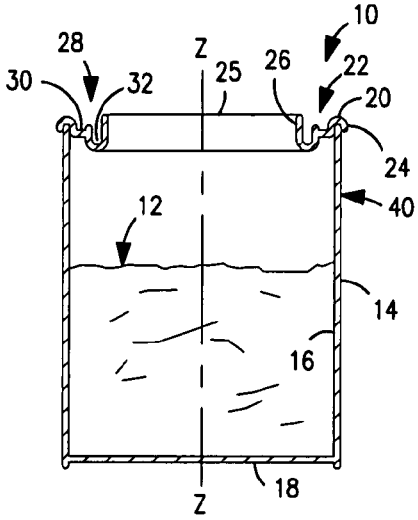
FIG. 2 is a vertical cross-sectional view of the paint can depicted in FIG. 1 taken along line 2-2.

Referring to FIGS. 1 and 2, a container 10 is shown in the form of a cylindrically shaped, paint can. The container 10 can be a one-gallon paint can, a quart size paint can, a pint size paint can or any other desired size. The container 10 can also vary as to shape and configuration. The container 10 can be cylindrical, as shown, or it could have a square, oval, elliptical, rectangular or any other geometrical shape. The container 10 has a longitudinal centerline X-X, a longitudinal centerline Y-Y aligned perpendicular to the longitudinal centerline X-X, and a vertical centerline Z-Z, see FIG. 2. The container 10 is designed to hold a fluid 12, see FIG. 2. The fluid 12 can be a liquid, for example paint. By "fluid" it is meant a continuous amorphous substance whose molecules move freely past one another and that assumes the shape of its container. By "liquid" it is meant a state of matter characterized by a readiness to flow, little or no tendency to disperse, and relatively high incompressibility.

Referring to FIG. 2, the container 10 includes a tubular side wall 14 having an inner surface 16. The tubular side wall 14 is closed at one end by a bottom wall 18 and has an upper surface 20. The upper surface 20 is essentially open except for an annular ring 22 which is formed adjacent to and is secured to the side wall 14. The annular ring 22 is securely joined to the side wall 14 by an annular bead 24. Those skilled in the art will recognize that other means for attaching the annular ring 22 to the side wall 14 can also be used. The annular ring 22 has an opening 25 formed therethrough. The annular ring 22 includes an inside wall 26 and has an annular channel 28 formed between the annular bead 24 and the inside wall 26. The annular channel 28 is depicted as being stepped in configuration and has an upper plateau 30 and a lower plateau 32. Again, the annular channel 28 can have a single plateau, if desired.

Referring back to FIG. 1, the container 10 is also shown having a handle 34 pivotably attached at 36 to two knobs 38, only one of which is shown. The two knobs 38 are spaced approximately 180 degrees apart around an outer circumference 40 of the container 10. The handle 34 serves as an easy way to lift, carry or tilt the container 10.

The container 10 can be formed from almost any material. The container 10 can be formed from ferrous or non-ferrous metal, including but not limited to: steel, stainless steel, tin, magnesium, etc. By "ferrous" it is meant any material relating to or containing iron, especially with a valence 2 or a valence lower than in a corresponding ferric compound. The container 10 can also be formed from other materials, including but not limited to: aluminum, plastic, fiberglass, or any composition of two or more materials.

A cover, not shown, normally closes off and seals the fluid 12, for example paint, inside the container 10 once it is initially filled at a factory. Although the fluid 12 can be almost any desired substance, it will be described as being a paint for purposes of describing this invention. However, one skilled in the art will recognize that the fluid 12 could be: varnish, stain, shellac, solvent, a liquid wall paper removal product, paste, glue, an adhesive, oil, etc. Desirably, the fluid 12 will be an interior or exterior paint. The paint can be oil based, Latex based or water based. The paint can be a primer or a finish coat. The paint can contain one or more additives to allow it to be a quick drying paint, a slow drying paint or a normal drying paint. The color of the paint can vary as well as the ingredients used to make up the paint.

Figure 3:
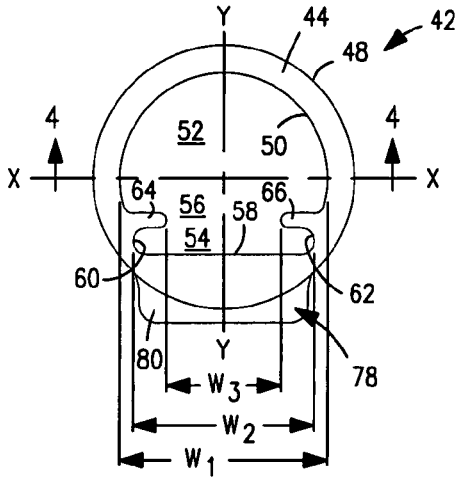
FIG. 3 is a top view of a brush wiping device having an outer perimeter slightly larger than the outer periphery of the paint can shown in FIG. 1 and having a brush dipping aperture, a brush wiping aperture and a brush transfer aperture formed therein.
Figure 4:
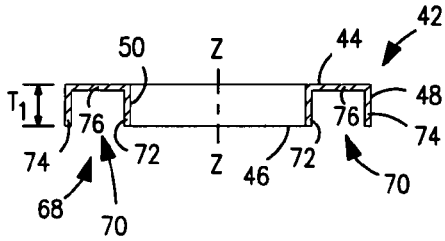
FIG. 4 is a cross-sectional view of the brush wiping device shown in FIG. 3 taken along line 4-4.

Referring now to FIGS. 3 and 4, a brush wiping device 42 is depicted which can be removably attached to the upper surface 20 of the container 10. The brush wiping device 42 is designed to be easily applied to and removed from the container 10. The brush wiping device 42 is in the form of an integral member having no moving parts. By "integral" it is meant a complete unit; a whole. The brush wiping device 42 is a one-piece, monolithic body. The brush wiping device 42 can be formed from various materials. Such materials include but are not limited to: aluminum, steel, metal, metal alloys, tin, magnesium, a composition of two or more materials, a plastic, thermoplastics such as polypropylene or polyethylene or compositions thereof, a hard plastic, a soft plastic, wood, plywood, composite board, rubber, hard rubber, etc. Desirably, the brush wiping device 42 is constructed from aluminum since it is light weight, durable, easy to machine and easy to clean.

The brush wiping device 42 has a first surface 44, a second surface 46 and a thickness $t_1$ therebetween, see FIG. 4. The thickness $t_1$ can vary in dimension depending upon the size of the container 10. The brush wiping device 42 is intended to be attached to and also depending upon the material out of which it is constructed. For a one-gallon paint can, the thickness $t_1$ can range from between about 0.2 inches to more than about 1 inch. Desirably, for an one-gallon paint can, the thickness $t_1$ can range from between about 0.25 inches to about 0.75 inches. More desirably, for a one-gallon paint can, the thickness $t_1$ can range from between about 0.3 inches to about 0.5 inches. Most desirably, for a one-gallon paint can, the thickness $t_1$ will be equal to about 0.375 inches.

For smaller or larger size containers 10, the brush wiping device 42 can vary in size.

Referring back to FIG. 3, the brush wiping device 42 also has an outer perimeter 48 and an inner perimeter 50. The shape or configuration of the outer perimeter 48 and the inner perimeter 50 can vary. In FIG. 3, the brush wiping device 42 has an outer perimeter 48 with an approximate circular profile. However, it should be understood that the profile of the outer perimeter 48, as viewed from the top, can be round, oval, square rectangular, triangular, hexagon, or have some other geometrical shape. Desirably, the outer perimeter 48 of the brush wiping device 28 is sized to be slightly larger than the outer circumference 40 of the container 10 to which it is to be fitted. However, the outer perimeter 48 of the brush wiping device 28 can be considerably greater than the outer circumference 40 of the container 10 to which it is to be fitted. One reason for making the outer perimeter 48 of the brush wiping device 28 larger than the circumference 40 of the container 10 it is to be fitted on is to ensure that it will fit over the annular ring 22 of the container 10 and stay securely in place during use. Desirably, the brush wiping device 28 will contact the annular bead 24 and/or the side wall 14 of the container 10.

The inner perimeter 50 of the brush wiping device 42 extends completely through the thickness $t_1$. The inner perimeter 50 is configured to include a brush dipping aperture 52, a brush wiping aperture 54 and a brush transfer aperture 56. The brush transfer aperture 56 communicates with both the brush dipping aperture 52 and the brush wiping aperture 54. No obstruction is present between the three apertures 52, 54 and 56.

The brush dipping aperture 52 can vary in shape and size. However, the brush dipping aperture 52 should be large enough to allow paint to be easily poured out of the container 10 and also allow paint, which was previously removed from the container 10, to be easily poured back into the container 10. The brush dipping aperture 52 should also be large enough to accommodate a paint brush and/ or a stir stick. The brush dipping aperture 52 is shown having a quasi semi-circular profile. The brush dipping aperture 52 has a maximum width dimension $w_1$ measured parallel to the longitudinal centerline X-X. The maximum width dimension $w_1$ can vary in length but normally it is a length of greater than about 4 inches. Desirably, the maximum width dimension $w_1$ of the brush dipping aperture 52 is a length of at least about 5 inches. More desirably, the maximum width dimension $w_1$ of the brush dipping aperture 52 has a length of about 5.25 inches.

The brush dipping aperture 52 also has a length measured parallel to the centerline Y-Y of at least about 2 inches. Desirably, the brush dipping aperture 52 has a length measured parallel to the centerline Y-Y of at least about 2.5 inches. More desirably, the brush dipping aperture 52 has a length measured parallel to the centerline Y-Y of at least about 3 inches.

Still referring to FIG. 3, the brush wiping aperture 54 also can vary in shape and size. The brush wiping aperture 54 is shown as an elongated opening having a linear side wall 58 located between a first rounded end 60 and a second rounded end 62. The linear side wall 58 should have a length at least equal to the maximum width dimension $w_3$ measured parallel to the longitudinal centerline X-X. Desirably, the length of the linear side wall 58 is less than 5 inches. More desirably, the length of the linear side wall 58 is less than 4 inches. Even more desirably, the length of the linear side wall 58 is about 3 inches so that it can accommodate a paint brush having a width of 3 inches or less. Most painters will use a 1 inch, a 1.5 inch, a 2 inch, a 2.5 inch or a 3 inch paint brush when working out of a one-gallon paint container 10, especially when they are applying paint to trim work.

Each of the first and second rounded ends, 60 and 62 respectively, can be semi-circular in configuration. Each of the first and second rounded ends, 60 and 62 respectively, can also be formed with some other arcuate profile, if desired. Each of the first and second rounded ends, 60 and 62 respectively, can have a radius of from between about 0.25 inches to about 2 inches. Desirably, each of the first and second rounded ends, 60 and 62 respectively, can have a radius of at least about 0.3 inches. More desirably, each of the first and second rounded ends, 60 and 62 respectively, can have a radius of at least about 0.35 inches. Even more desirably, each of the first and second rounded ends, 60 and 62 respectively, can have a radius of at least about 0.375 inches.

The brush wiping aperture 54 has a maximum width dimension $w_2$ measured parallel to the longitudinal centerline X-X. The maximum width dimension $w_2$ can vary in length but normally it is a length of greater than about 2.5 inches. Desirably, the maximum width dimension $w_2$ of the brush wiping aperture 54 is a length of at least about 3 inches. More desirably, the maximum width dimension $w_2$ of the brush wiping aperture 54 has a length of about 3.5 inches.

The brush transfer aperture 56 can vary in shape and size. In FIG. 3, the brush transfer aperture 56 is shown having a narrow elongated shape with a maximum width dimension $w_3$ measured parallel to the longitudinal centerline X-X. The maximum width dimension $w_3$ can vary in length but normally it is a length of greater than about 2.5 inches. Desirably, the maximum width dimension $w_3$ of the brush transfer aperture 56 is a length of at least about 2.75 inches. More desirably, the maximum width dimension $w_3$ of the brush transfer aperture 56 has a length of about 3 inches.

Still referring to FIG. 3, the three apertures 52, 54 and 56 are aligned such that all three apertures communicate with one another. No structure is present that would prevent a paint brush from freely moving between any of the three apertures 52, 54 and 56. The maximum width dimension $w_1$ of the brush dipping aperture 52 is greater than the maximum width dimension $w_2$ of the brush wiping aperture 54 which in turn is greater than the maximum width dimension $w_3$ of the brush transfer aperture 56. In addition, the maximum width dimension $w_3$ of the brush transfer aperture 56 is greater than half of the maximum width dimension $w_1$ of the brush dipping aperture 52. Furthermore, the maximum width dimension $w_2$ of the brush wiping aperture 54 is greater than half of the maximum width dimension $w_1$ of the brush dipping aperture 52. Desirably, the maximum width dimension $w_2$ of the brush wiping aperture 54 is at least 0.5 inches larger than the maximum width dimension $w_3$ of the brush transfer aperture 56.

Referring again to FIG. 1, one will clearly see that the opening 25 in the container 10 forms 100% of the surface area of the opening formed in the container 10. Once the brush wiping device 42 is attached to the container 10, the combination of the brush dipping aperture 52, the brush wiping aperture 54 and the brush transfer aperture 56 expose at least 70% of the opening 25. Desirably, the combination of the brush dipping aperture 52, the brush wiping aperture 54 and the brush transfer aperture 56 expose at least 80% of the opening 25. More desirably, the combination of the brush dipping aperture 52, the brush wiping aperture 54 and the brush transfer aperture 56 expose at least 85% of the opening 25. Even more desirably, the combination of the brush dipping aperture 52, the brush wiping aperture 54 and the brush transfer aperture 56 expose at least 90% of the opening 25.

Figure 5:
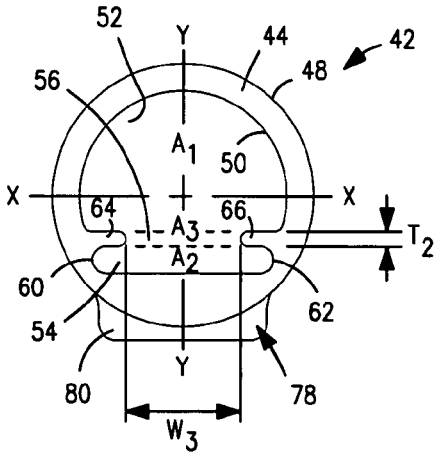
FIG. 5 is a top view of a brush wiping device having a pair of dashed lines added to help differentiate the surface area $A_1$ of the brush dipping aperture from the surface area $A_2$ of the brush wiping aperture, and the surface area $A_3$ of the brush transfer area.
Figure 6:
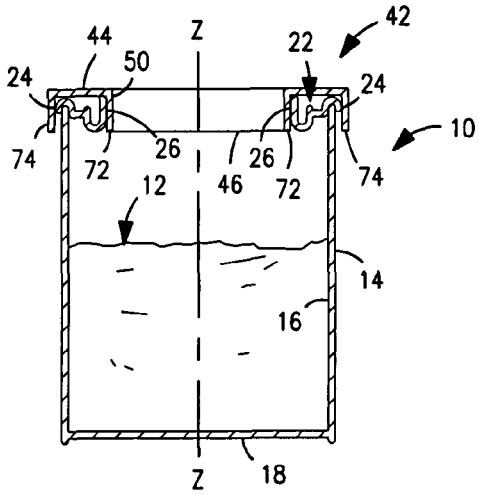
FIG. 6 is a cross-sectional view of the paint can with the brush wiping device attached to an upper surface of the paint can and with paint being present in the paint can.

Referring to FIG. 5, in addition to the differences in maximum width dimension $w_1$, $w_2$ and $w_3$, the brush dipping aperture 52 has a maximum surface area $A_1$, measured parallel to the first surface 44 of the brush wiping device 42. The brush wiping aperture 54 also has a maximum surface area $A_2$, measured parallel to the first surface 44 of the brush wiping device 42, and the brush transfer aperture 56 has a maximum surface area $A_3$ measured parallel to the first surface 44 of the brush wiping device 42. As stated above, the three apertures 52, 54 and 56 are aligned such that all three apertures communicate with one another. As shown in FIG. 3, the maximum surface area $A_1$ of the brush dipping aperture 52 is greater than the maximum surface area $A_2$ of the brush wiping aperture 54, which in turn is greater than the maximum surface area $A_3$ of the brush transfer aperture 56.

Still referring to FIG. 5, the brush wiping device 42 has a pair of projections 64 and 66 which separate the first and second rounded ends, 60 and 62 respectively, of the brush wiping aperture 54, from the brush dipping aperture 52. The pair of projections 64 and 66 can be in the forms of fingers or tongues which are separated by the maximum width dimension $w_3$ measured parallel to the longitudinal centerline X-X. Each of the pair of projections, 64 and 66 has a thickness $t_2$. The thickness $t_2$ of each of the pair of projections 64 and 66 define the width of the brush transfer aperture 56. The thickness $t_2$ times the maximum width dimension $w_3$ determines the surface area $A_3$ Of the brush transfer aperture 56.

Referring again to FIG. 4, the brush wiping device 42 also includes an attachment member 68. The attachment member 68 is shown being formed in the second surface 46 of the brush wiping device 42. The attachment member 68 removably secures the brush wiping device 42 to the upper surface 20 of the container 10. The attachment member 68 is depicted as an annular channel 70 having an inner side wall 72, an outer side wall 74 which is spaced apart from the inner side wall 72, and a bottom wall 76. The bottom wall 76 joins the inner side wall 72 to the outer side wall 74. The bottom wall 76 is located between the first and second surfaces, 44 and 46 respectively, of the brush wiping device 42. The bottom wall 76 is located below the first surface 44 of the brush wiping device 42. The annular channel 70 can be formed in the second surface 46 of the brush wiping device 42 by various means, including but not limited to, machining, water jet cutting, forging, stamping, extruding, molding, etc.

Referring now to FIGS. 3-7, the annular channel 70 of the brush wiping device 42 is designed, sized and configured to snugly fit onto the upper surface 20 of the container 10. By "snugly" it is meant a close and/or tight fit such as an interference fit. For example, after the brush wiping device 42 is attached to the container 10, if one were to turn the container 10 upside down, the brush wiping device 42 would not separate or fall away from the container 10. On the other hand, the brush wiping device 42 is not intended to be a permanent attachment and is sized to be easily and quickly removed from the container 10. The annular channel 70 is sized and configured so that it can be pressed or pushed, using one or two hands, onto the upper surface 20 of the container 10.

Figure 7:
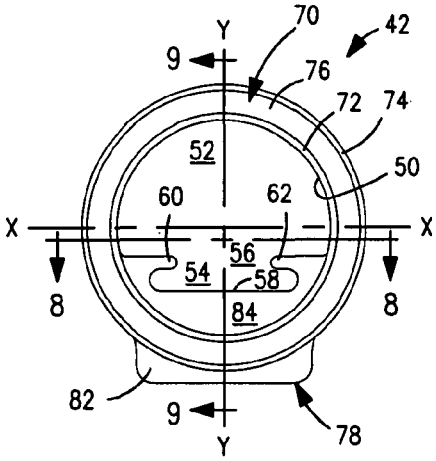
FIG. 7 is a bottom view of the brush wiping device shown in FIG. 3 depicting an annular channel and having a brush dipping aperture, a brush wiping aperture and a brush transfer aperture formed within the inner periphery of the annular channel.
Figure 8:
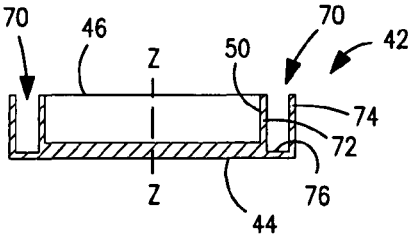
FIG. 8 is a cross-sectional view of the brush wiping device shown in FIG. 7 taken along line 8-8.

The brush wiping device 42 is also configured to have a tab 78, which has an upper surface 80, see FIGS. 3 and 5, and a lower surface 82, see FIG. 7. The tab 78 can be crescent or arcuately shaped so as to project outward from the major portion of the brush wiping device 42. The upper surface 80 of the tab 78 is shown being aligned flush with the first surface 44 of the brush wiping device 42. However, the upper surface 80 can be constructed so that it is aligned above or below the first surface 44 of the brush wiping device 42, if desired. The tab 78 extends outwardly away from the side wall 14 of the container 10. The tab 78 can be of various size and shape and is depicted having an arcuate profile in FIG. 3.

The tab 78 should extend outward away from the remainder of the brush wiping device 42 by at least about 0.1 inches; desirably by about 0.2 inches; and more desirably, by about 0.25 inches. The tab 78 provides a lip or ledge which allows a person, for example a painter, to place his/her fingers under the tab 78 so as to easily lift and remove the brush wiping device 42 from the upper surface 20 of the container 10. In other words, the tab 78 facilitates removal of the brush wiping device 42 from the container 10. The brush wiping device 42 can be easily removed from the container 10, by having a person hold the container 10 stationary with one hand while using his/her other hand to pull upward on the tab 78. This action will cause the annular channel 70 of the brush wiping device 42 to separate from the upper surface 20 of the container 10.

The brush wiping device 42 can be used over and over again. The brush wiping device 42 should be cleaned, by wiping off any paint using water and/or a solvent. The brush wiping device 42 can then be wiped dry or be allowed to air dry before being attached onto another container 10. It is contemplated that the brush wiping device 42 can be used for years before it has to be replaced.

Referring to FIGS. 6-9, the annular channel 70 is sized to snugly fit onto the container 10 such that the inner side wall 72 of the annular channel 70 contacts the inside wall 26 of the annular ring 22 and the outer side wall 76 of the annular channel 70 contacts the annular bead 24 of the annular ring 22. The annular channel 70 will prevent any paint from entering and pooling in the annular ring 22. This will eliminate the need to clean paint out of the annular ring 22 before the container lid is reapplied when the paint container 10 is to be stored away. By preventing paint from getting into the annular ring 22, one can prevent wasteful and unsightly hardening of paint in the annular ring 22. As the outer side wall 76 of the annular channel 70 passes down below the annular bead 24, it will be spaced at a slight clearance from the side wall 14 of the container 10. If the brush wiping device 42 is made from a flexible plastic material, the outer side wall 76 may contact the side wall 14 of the container 10 below the annular bead 24 just because of its pliable characteristics.

Figure 9:
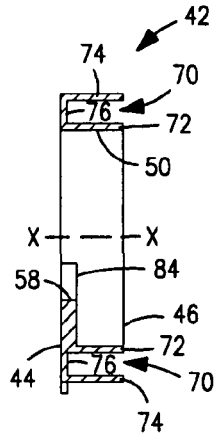
FIG. 9 is an end view of the brush wiping device shown in FIG. 7 taken along line 9-9.

Referring to FIG. 9, one will notice that the linear side wall 58 of the brush wiping aperture 54 has a lower surface 84 located between the first and second surfaces, 44 and 46 respectively, of the brush wiping device 42. The lower surface 84 is shown being located farther away from the first surface 44 than is the bottom wall 76 of the annular channel 70. In other words, the lower surface 84 of the linear side wall 58 is aligned closer to the second surface 46 of the brush wiping device 42 than is the bottom surface 76 of the annular channel 70. This thicker construction will permit the linear side wall 58, which is the major wiping edge for the paint brush, to have a longer life.

Figure 10:
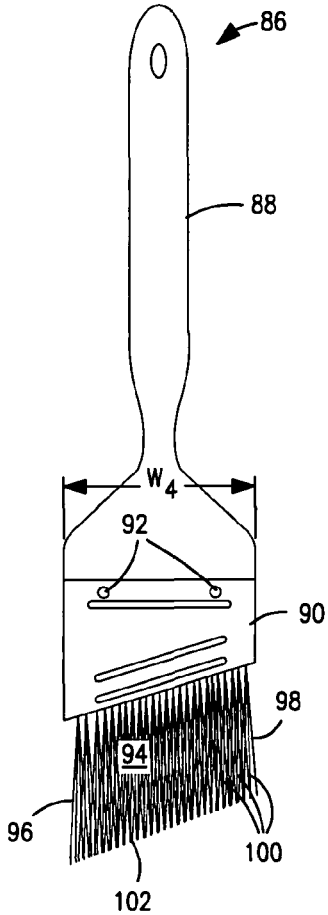
FIG. 10 is a front view of a paint brush.

Referring to FIG. 10, a paint brush 86 is depicted having an elongated handle 88 which is commonly constructed of wood or plastic. A hollow sleeve 90 is secured to the handle 88 by one or more fasteners 92. The fasteners 92 can be screws, pins, studs, nails, or tacks, or a combination of one or more such fasteners. The fasteners 92 can also be other type fasteners known to those skilled in the art. The hollow sleeve 90 is commonly constructed from a non-corrosive material, such as stainless steel, so that it will not rust. The hollow sleeve 90 encircles 360 degrees and typically has a wide width $w_4$ separated by narrow rounded ends. The narrow, elongated profile is formed by a pair of major surfaces 94, only one being shown. The second major surface is arranged parallel to and behind the first major surface 94 and is spaced apart by at least 0.15 inches, desirably about at least 0.25 inches. The pair of major surfaces 94 terminates at a first rounded end 96 and a second rounded end 98. The length of each of the first and second major surfaces 94, measured parallel to the width dimension $w_4$, can vary but usually they have a set dimension that determines the size of the paint brush. For example, when the width $w_4$ of each of the first and second major surfaces 94 is 2 inches, the paint brush 86 is referred to as a 2 inch brush. When the width $w_4$ of each of the first and second major surfaces 94 is 2.5 inches, the paint brush 86 is referred to as a 2.5 inch brush, etc.

A plurality of paint bristles 100 are securely held in the hollow sleeve 90. Typically, hundred of individual bristles 100 are held secure in the hollow sleeve 90. Each of the plurality of bristles 100 is formed from natural or synthetic materials. Examples of natural materials include but are not limited to: animal hair, human hair, fibers from various plants, etc. Examples of synthetic materials include but are not limited to: synthetic fibers made out of polypropylene, polyethylene, combinations thereof, etc. The paint bristles 100 are designed to soak up and hold the paint. The paint bristles 100 can then deposit the paint, onto another surface, such as a wall, a ceiling or a floor. The paint can also be applied to almost any other structural member, such as the leg of a chair, the top of a table, etc. Almost any known structural object can be painted.

It should be noted that the plurality of paint bristles 100 have a free end 102. The free end 102 can be cut at an angle, as shown, or be formed parallel to the width $w_4$ of the hollow sleeve 90.

Method

A method of removing excess paint from a paint brush 86 will now be explained. This method allows excess paint to be quickly and efficiently removed from the bristles 100 of a paint brush 86 in two simple strokes. This method can be used by a person who is either right handed or left handed. This method prevents the paint from splattering onto other objects in close proximity to the paint container 10. It should again be noted that even though the description will refer to paint, any fluid, including but not limited to: a water based paint, an oil based paints, a water color, a varnish, a shellac, an ink, a stain, a wall paper remover, an oil, a solvent, etc. can be used. The paint brush 86 will contain a plurality of paint bristles 100 having a pair of major surfaces 94 and first and second rounded ends, 96 and 98 respectively.

The method includes the steps of attaching a brush wiping device 42 onto an upper surface 20 of an open paint container 10. Normally, each paint container 10 is sealed by a lid or cover at the factory where the paint is manufactured and packaged. The lid or cover is removed at the job site. Desirably, some of the paint in the container 10 is removed by being poured out into a painting tray or bucket such that the container 10 is not completely full. Typically, when two painters are working on painting a room, one painter will used some of the paint in a roller tray while the second painter will use a paint brush to paint the trim work.

The paint container 10 will hold or house a certain volume of paint 12. The brush wiping device 42 has a first surface 44, a second surface 46, a thickness $t_1$, an outer perimeter 48 and an inner perimeter 50. The inner perimeter 50 extends completely through the thickness $t_1$ and is configured to include a brush dipping aperture 52, a brush wiping aperture 54 and a brush transfer aperture 56. The brush dipping aperture 52 is of sufficient size to permit the paint brush 86 or a stir stick to be inserted into it and be moved about in any direction for at least a couple of inches. The brush transfer aperture 56 communicates with both the brush dipping aperture 52 and the brush wiping aperture 54. The brush wiping aperture 54 has a linear side wall 58, a first rounded end 60 and a second rounded end 62. The linear side wall 58 is a flat surface situated between the first and second rounded ends, 60 and 62 respectively. The radii of the rounded ends 60 and 62 are sized to easily accommodate a 2.5 inch paint brush.

At least a portion of the paint brush 86 is passed downward through the brush dipping aperture 52 and into the paint container 10. This will permit at least some of the paint bristles 100 to contact, collect and hold some of the paint 12. The paint brush 86 is then moved upward and laterally so as to traverse from the brush dipping aperture 52 through the brush transfer aperture 56 and into the brush wiping aperture 54. By "traverse" it is meant to direct the travel of the paint brush 86 upward and laterally across from the brush dipping aperture 52 to the brush wiping aperture 54 via the brush transfer aperture 56.

A first wiping stroke is then performed by wiping the first major surface 94 against the flat, linear side wall 58 and simultaneously wiping one of the rounded ends, 96 or 98, of the paint bristles 100 against one of the rounded ends, 60 or 62, of the brush wiping aperture 54. This action will remove excess or surplus paint from a major surface 94 and from an end, 96 or 98, of the paint brush 86. The paint brush 86 is then rotated 180 degrees by the hand and fingers of the painter. At least a portion of the paint brush 86 is again moved or passed downward through the brush dipping aperture 52 and into the container 10. The paint bristles 100 are not allowed to contact additional paint 12 stored within the container 10. This action causes at least a portion of the paint bristles 100, which contain excess or surplus paint 12, to be located below the brush wiping device 42 but above the upper surface of the paint 12 stored in the container 10. The paint brush 86 is then moved upward and laterally so as to traverse from the brush dipping aperture 52 through the brush transfer aperture 56 and into the brush wiping aperture 54. A second wiping stroke is then performed by wiping the second major surface 94 against the flat, linear side wall 58 and simultaneously wiping the other rounded end, 96 or 98, of the paint bristles 100 against one of the rounded ends, 60 and 62. This action will remove excess or surplus paint from the other major surface 94 and from the other end, 96 or 98, of the paint brush 86. So in two simple strokes, a person is able to wipe excess paint 12 from all four surfaces of the paint brush 86. The excess paint 12 scrapped off the paint brush 86 will drain or drip back into the container 10 from the linear side wall 58 and can be used at a later time.

It should be noted that both of the rounded ends, 96 and 98, of the paint bristles 100 can be sequentially wiped against the same rounded end, 60 or 62, of the brush wiping aperture 54. It has been found that right handed people will typically use one of the ends 60 or 62 and left handed people will typically use the other end, 60 or 62.

It should also be understood that the hollow sleeve 90 of the paint brush 86 can also be wiped against the linear side wall 58 of the brush wiping aperture 54 to remove excess paint 12 from it. This action can prevent the paint 12 from flowing or running onto the handle 88 of the paint brush 86 and therefore will keep the hand of the painter free of paint.

The brush wiping device 42 can be utilized on a single paint container 10 and the paint container 10 can be refilled one or more times. Eventually, the brush wiping device 42 can be removed from the paint container 10. The brush wiping device 42 can be cleaned to remove any paint that has adhered to it. The brush wiping device 42 can be cleaned using water or a solvent, dependent upon what type of paint 12 was in the paint container 10. The brush wiping device 42 should be wiped dry or allowed to air dry over time. The brush wiping device 42 can then be subsequently attached to another paint container 10. It is envisioned that the brush wiping device 42 can be used repeatedly and will last for many years. Such a brush wiping device 42 is environmentally friendly since it does not have to be discarded after a single use.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. A brush wiping device that can be attached to an upper surface of a container, said container capable of housing a fluid, said brush wiping device comprising:

a) a first surface, a second surface and a thickness there between, an outer perimeter and an inner perimeter, said inner perimeter extending completely through said thickness, said inner perimeter being configured to include:

a brush dipping aperture;

a brush wiping aperture; and a brush transfer aperture, wherein said brush transfer aperture communicates with both said brush dipping aperture and said brush wiping aperture;

said brush transfer aperture has a brush transfer aperture width defined by the shortest distance between a first projection and a second projection; and said brush wiping aperture comprises:

a first brush wiping aperture side defined by a continuous wall;

a first brush wiping aperture arcuate end;

a second brush wiping aperture arcuate end; and a second brush wiping aperture side defined by said first projection and said second projection and is without obstruction to said brush transfer aperture along the entirety of said brush transfer aperture width; and b) an attachment member formed in said second surface for removably securing said brush wiping device to the container wherein said brush dipping aperture has a maximum width dimension $w_1$, said brush wiping aperture has a maximum width dimension $w_2$ and said brush transfer aperture has a maximum width dimension $w_3$, and $w_1$ is greater than $w_2$ which is greater than $w_3$, wherein said maximum width dimension $w_3$ of said brush transfer aperture is greater than half of said maximum width dimension $w_1$ of said brush dipping aperture.

2. The brush wiping device of claim 1 wherein said attachment member comprises an annular channel which is sized to snugly engage the container.

3. The brush wiping device of claim 2 wherein said annular channel has an inner side wall, an outer side wall spaced apart from said inner side wall, and a bottom wall joining said inner and outer side walls together, said bottom wall being located below said first surface of said brush wiping device.

4. The brush wiping device of claim 3 said brush wiping aperture has a linear side wall with a lower surface located between said first and second surfaces, and said lower surface is located farther away from said first surface than is said bottom wall of said annular channel.

5. The brush wiping device of claim 1 wherein said maximum width dimension $w_2$ of said brush wiping aperture is greater than half of said maximum width dimension $w_1$ of said brush dipping aperture.

6. The brush wiping device of claim 1 wherein said brush wiping device has an exterior perimeter defining a total wiping device area, and said brush dipping aperture, said brush wiping aperture and said brush transfer aperture combine to create a total aperture area of at least 80% of said total wiping device area.

7. The brush wiping device of claim 6 wherein said total aperture area is at least 85% of said total wiping device area.

* * * * *